US005316059A

United States Patent [19]

Lahnan et al.

[11] Patent Number: 5,316,059

[45] Date of Patent: May 31, 1994

[54] OIL FILLER FUNNEL CAP

[75] Inventors: Robert A. Lahnan, East Springfield; Raymond L. Diehl, Girard, both of Pa.

[73] Assignee: Springfield Investments, Inc., West Springfield, Pa.

[21] Appl. No.: 21,259

[22] Filed: Mar. 1, 1993

[51] Int. Cl.[5] ..... B65B 39/00

[52] U.S. Cl. ..... 141/340; 141/331; 141/98; 220/86.2; 184/1.5; 184/105.1

[58] Field of Search ..... 141/98, 331, 332, 339-342, 141/364; 220/86.1, 86.2; 184/1.5, 88.1, 88.2, 92, 94, 105.1; 123/196 R

[56] References Cited

U.S. PATENT DOCUMENTS

| | | | |
|---|---|---|---|
| 998,352 | 7/1911 | Kublin | 141/340 X |
| 1,497,048 | 6/1924 | Vodoz | 141/331 X |
| 1,812,670 | 6/1931 | Wahl | 220/86.2 |
| 2,197,987 | 4/1940 | Rogers | 141/340 |
| 4,338,983 | 7/1982 | Hatcher | 141/331 |
| 4,559,984 | 12/1985 | Wycech | 141/340 |
| 4,703,867 | 11/1987 | Schoenhard | 141/98 |
| 4,896,746 | 1/1990 | Desjardins | 184/92 |
| 5,033,521 | 7/1991 | Martin | 141/337 |

*Primary Examiner*—J. Casimer Jacyna
*Attorney, Agent, or Firm*—Harpman & Harpman

[57] ABSTRACT

An improvement in an oil filler funnel cap that replaces the normal oil filler cap on internal combustion engines. The improved filler funnel cap is adjustable to fit a variety of different size oil filler openings forming an enlarged funnel receptacle with a resilient sealing closure.

4 Claims, 2 Drawing Sheets

FIG. 3
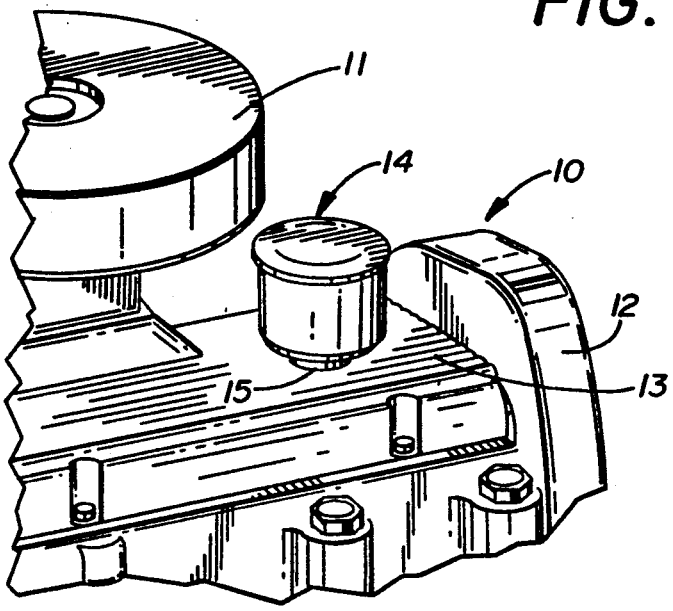
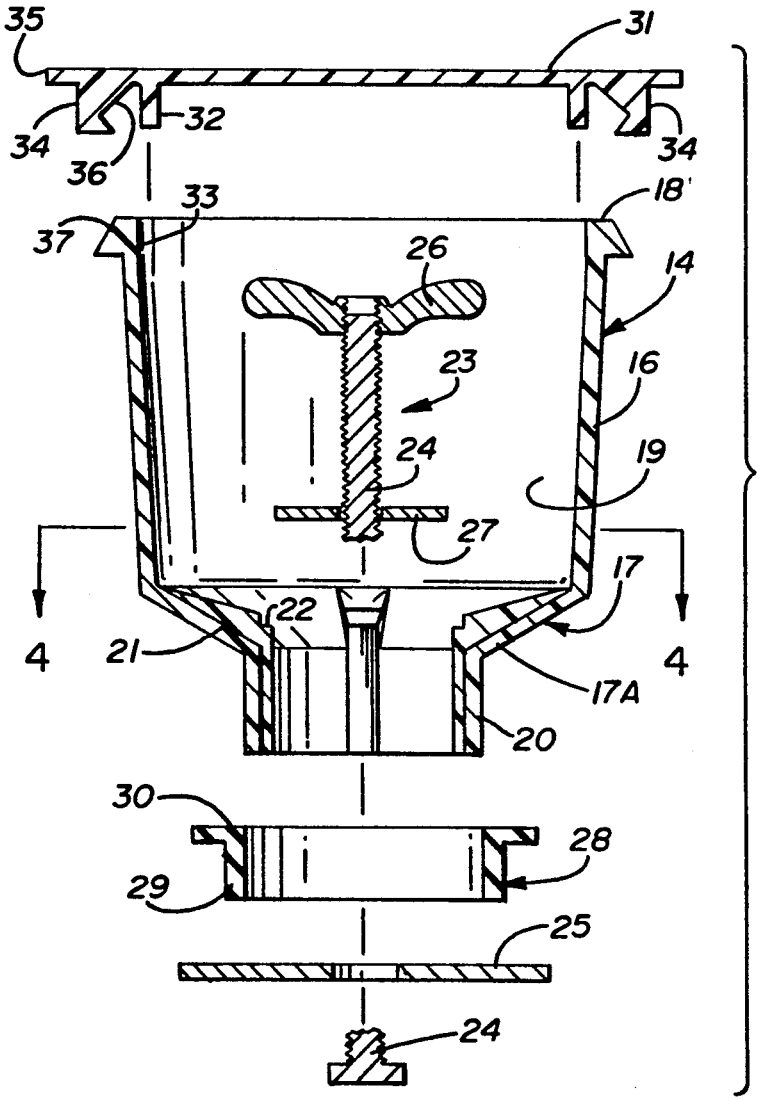
FIG. 1

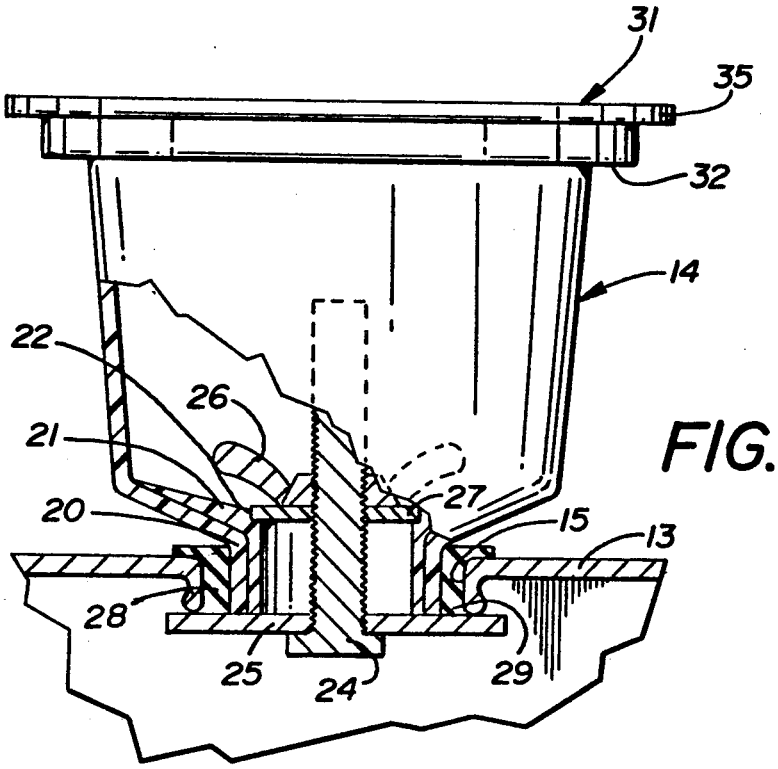
FIG. 2
FIG. 5
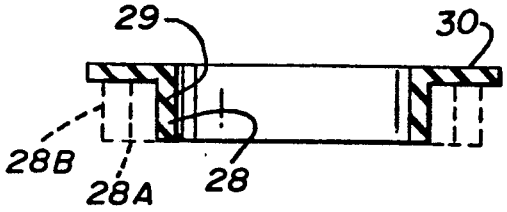
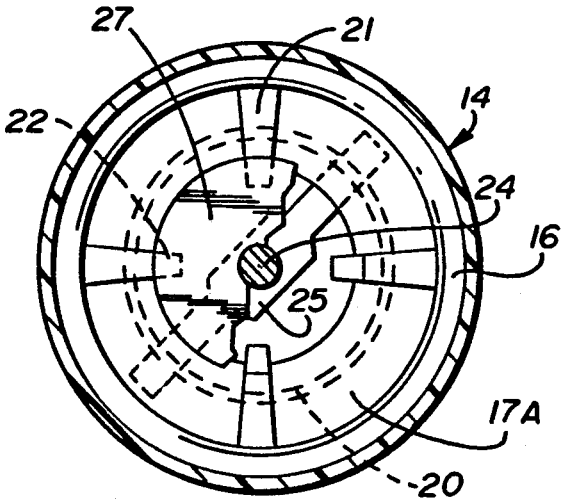
FIG. 4

OIL FILLER FUNNEL CAP

BACKGROUND OF THE INVENTION

1. Technical Field

This device relates to accessories for engines that are used in the addition or replenishment of engine oil into the engine.

2. Description of Prior Art

Prior art devices of this type have relied on a variety of different oil filler cap embodiments that are secured to the oil inlet opening on the valve cover of internal combustion engines. These devices provide a larger funnel receptacle into which oil can be added without the use of an auxiliary funnel or pour spout. Examples of prior art devices directed to this problem are U.S. Pat. Nos. 5,033,521, 4,703,867, 4,896,746 and 4,338,983.

In U.S. Pat. No. 5,033,521 a cap with a collapsible funnel is disclosed that has a telescopically expansible multiple interconnected sections that can be collapsed upon themselves when not in use. The sections can be vertically extended i.e. expanded for use defining an elaborate telescopically extensible funnel to facilitate the addition of oil through the oil filler cap opening on the valve cover of a typical internal combustion engine.

U.S. Pat. No. 4,703,867 is directed to an oil filler funnel and cap which has an open top collection chamber positioned on top of a support and fill pipe that is secured to the oil filler opening in the valve cover of an engine. A retainer bar, ring assembly engages the valve cover and inner surface of the pipe locking the fill pipe in place by rotation. A hinge cap is removably positioned on the collection chamber's open top.

U.S. Pat. No. 4,896,746 is directed to a covered storage funnel for the fuel compartment on a lawn mower engine. A first storage compartment is within the body of the device to receive gasoline and/or oil mixture above the fuel tank of the lawn mower. A release valve assembly is within the storage compartment that opens upon rotation to release the contents of the container into the fuel tank of the lawn mower.

In U.S. Pat. No. 4,338,983 an oil cap with self-contained funnel for automobiles is disclosed in which a funnel is secured a top a long neck portion, the end of which is inserted into the oil filler opening on the engine.

A support bracket extends from the cover on the funnel so that the assembly can be secured to the automobile.

SUMMARY OF THE INVENTION

An improvement in an oil filler funnel cap for use on internal combustion engines to provide a permanent enlarged oil filler opening in to which engine oil is added. The improved oil filler cap is selectively secured within the oil filler opening of the engine by an interchangeable resilient insert and an internal locking assembly. A resilient closure is removably secured to the open end of the filler provide and provides for easy access thereto.

DESCRIPTION OF THE DRAWINGS

FIG. 1 is an exploded side plan sectional view of the oil filler funnel device;

FIG. 2 is a side sectional view of the oil filler funnel on an engine;

FIG. 3 is a perspective view of a portion of an engine onto which the oil filler funnel of the invention is installed;

FIG. 4 is a top plan sectional view on lines 4-4 of FIG. 1; and

FIG. 5 is an enlarged cross-sectional view of a resilient insert with an alternate insert shown in dotted lines.

DESCRIPTION OF THE PREFERRED EMBODIMENT

Referring to FIGS. 2 and 3 of the drawings, a portion of an internal combustion engine 10 is shown having an air cleaner 11, a fan housing 12 and a valve cover 13 onto which an oil filler funnel cap 14 of the invention is positioned. The valve cover 13 has an oil access opening at 15 to allow for the addition of oil (not shown) into the engine as will be well known to those skilled in the art.

Referring now to FIGS. 1, 2, and 4 of the drawings, the oil filler funnel cap 14 of the invention can be seen having a continuous side wall 16, a contoured bottom 17 and an annular lip 18 defining an oil receiving chamber 19. The contoured bottom 17 has a tapered bottom wall 17A that terminates in and is integral with a tubular extension 20. A plurality of annularly spaced oppositely disposed tapered ribs 21 extend vertically from the tapered bottom 17A as best seen in FIGS. 1-4 of the drawings. Each of said ribs 21 are notched at 22 respectively and extend downwardly therefrom into the tubular extension 20 hereinbefore described. A retaining nut and bolt assembly 23 is positioned within said oil receiving chamber 19 and extends outwardly through said tubular extension 20. The retaining nut and bolt assembly 23 is comprised of a threaded bolt 24 having an apertured retaining bar 25 thereon below said tubular extension 20. A wing nut 26 and engagement washer 27 are positioned on said threaded bolt's free end within the chamber 19.

Referring now to FIGS. 1,2, and 5 of the drawings, a resilient insert spacer gasket 28 can be seen having a cylindrical body member 29 with a right angular flange 30 defining said gasket's upper perimeter edge. It will be noted that the alternate gasket configurations 28A and 28B are shown in dotted lines in FIG. 5 of the drawings in which the transverse dimension of the respective cylindrical body members 28A and 28B is greater than that of said cylindrical body member 29 shown in solid lines in FIG. 5 of the drawings.

In use, the oil filler funnel cap 14 is positioned within the oil access opening 15 in the valve cover 13, resiliently sealing therebetween via said selective insert spacer gasket 28. The apertured restraining bar 25 on the threaded nut and bolt assembly 23 is rotated to engage a downturned portion 15A of the access opening 15. The threaded wing nut 26 is advanced down the bolt 24 against the engagement washer 27 that is seated on the ribs 21 in the respective notches 22 therein as hereinbefore described.

Referring to FIG. 1 of the drawings, a flexible closure element 31 can be seen having an annular downturned flange 32 that frictionally engages within an inner perimeter edge 33 of the side wall 16. A contoured annular downturned flange 34 extends from the flexible closure element 21 inwardly of its perimeter edge 35 in spaced relation to the flange 32.

It will be seen that the respective flange 32 and contoured flange 34 define a contoured annular groove 36 therebetween that is registerable over an outwardly extending annular lip 37 defining the opening of the funnel cap 14 hereinbefore described.

A flexible closure 31 provides a removable seal for the funnel cap 14 so that make-up oil (not shown) can be added.

In the preferred embodiment as hereinbefore described, the funnel cap 14 is molded of a synthetic resin plastic material which simplifies production and provides an integral funnel cap 14, ribs 21 and tubular extension 20. The flexible closure 31 can also be of a molded synthetic flexible plastic composition.

It will be apparent to those skilled in the art that various changes and modifications may be made therein without departing from the spirit of the invention, therefore

I claim:

1. An oil filler device mounted on an internal combustion engine by insertion into an oil access opening within said engine, said oil filler device comprising a funnel cap having a continuous side wall, a contoured bottom and an interconnected tubular extension extending therefrom, means for sealingly engaging said tubular extension within said oil access opening comprising, a resilient insert spacer and a retaining nut and bolt assembly in communication with said funnel cap and said oil access opening, a plurality of annularly spaced tapered engagement ribs extending from said bottom for supporting said nut and bolt assembly and extending downwardly into said tubular extension, retaining nut and bolt assembly comprising a retaining bar and an engagement washer on a threaded bolt, a flexible closure element releaseably secured to said container side wall and means for removably securing said flexible closure element to said side wall.

2. The oil filler device of claim 1 wherein said resilient insert spacer has a cylindrical body member, having a flange extending therefrom.

3. The oil filler device of claim 1 wherein said means for removably securing said flexible closure element to said container side wall of said funnel cap comprises a first downturned annular flange extending from a flexible closure, a second contoured downturned annular flange in spaced relation to said first flange, said first and second flanges defining a contoured groove therebetween, an annular lip extending from said side wall in registration relation with said contoured groove.

4. The oil filler device of claim 1 wherein said funnel cap and said flexible closure engageable thereon are made of synthetic resin plastic material.

* * * * *